US007987919B2

(12) United States Patent
Paprocki

(10) Patent No.: US 7,987,919 B2
(45) Date of Patent: Aug. 2, 2011

(54) DISCONTINUOUS TIGHTENING WRENCH COMPRISING MEANS FOR MEASURING DYNAMIC EVENTS CAUSED BY THIS TIGHTENING ON THE CASING OF THE WRENCH

(75) Inventor: Norbert Paprocki, Nantes (FR)

(73) Assignee: Etablissements Georges Renault, Saint Herblain (FR)

( * ) Notice: Subject to any disclaimer, the term of this patent is extended or adjusted under 35 U.S.C. 154(b) by 263 days.

(21) Appl. No.: 12/093,910

(22) PCT Filed: Nov. 15, 2006

(86) PCT No.: PCT/EP2006/068531

§ 371 (c)(1),
(2), (4) Date: Sep. 9, 2008

(87) PCT Pub. No.: WO2007/057424

PCT Pub. Date: May 24, 2007

(65) Prior Publication Data

US 2009/0114411 A1 May 7, 2009

(30) Foreign Application Priority Data

Nov. 15, 2005 (FR) ..... 05 11565

(51) Int. Cl.
*B25B 23/14* (2006.01)

(52) U.S. Cl. ..... 173/2; 173/93.5; 173/176; 173/181; 73/862.23

(58) Field of Classification Search ..... 173/181, 173/176, 183, 93, 93.5, 2; 81/469, 479; 73/862.23
See application file for complete search history.

(56) References Cited

U.S. PATENT DOCUMENTS

| | | | | |
|---|---|---|---|---|
| 3,464,503 | A | 9/1969 | Houck | 173/20 |
| 4,016,938 | A * | 4/1977 | Rice | 173/1 |
| 4,571,696 | A * | 2/1986 | Bitzer | 700/253 |
| 5,476,014 | A | 12/1995 | Lampe et al. | 73/862.23 |
| 5,526,460 | A * | 6/1996 | DeFrancesco et al. | 388/831 |
| 5,848,655 | A * | 12/1998 | Cooper et al. | 173/176 |
| 6,144,891 | A * | 11/2000 | Murakami et al. | 700/108 |
| 6,167,788 | B1 | 1/2001 | Schönberger et al. | 81/467 |
| 6,546,815 | B2 * | 4/2003 | Yamada et al. | 73/862.21 |
| 6,761,229 | B2 * | 7/2004 | Cripe et al. | 173/176 |
| 6,965,835 | B2 * | 11/2005 | McGee et al. | 702/41 |
| 6,978,846 | B2 * | 12/2005 | Kawai et al. | 173/2 |
| 7,082,866 | B2 * | 8/2006 | Becker | 81/479 |

FOREIGN PATENT DOCUMENTS

EP 1 208 946 5/2005

OTHER PUBLICATIONS

Patent Abstracts of Japan, vol. 1998. n°03; Feb. 27, 1998 & JP 09 285974 (Yamazaki Haguruma Seisakushko:KK), Nov. 4, 1997.
International Search Report of corresponding foreign Application No. PCT/EP2006/068531.

* cited by examiner

*Primary Examiner* — Scott A. Smith
(74) *Attorney, Agent, or Firm* — David D. Brush; Westman, Champlin & Kelly, P.A.

(57) ABSTRACT

The invention relates to a discontinuous clamping wrench, of the type comprising a motor and a pulse clutch integrated in a casing, characterised in that it comprises measurement means of dynamic phenomena induced by said clamping on said casing, with a view to correlating said measurement with a clamping level.

11 Claims, 2 Drawing Sheets

DISCONTINUOUS TIGHTENING WRENCH COMPRISING MEANS FOR MEASURING DYNAMIC EVENTS CAUSED BY THIS TIGHTENING ON THE CASING OF THE WRENCH

CROSS-REFERENCE TO RELATED APPLICATIONS

This Application is a Section 371 National Stage Application of International Application No. PCT/EP2006/068531, filed Nov. 15, 2006 and published as WO 2007/057424A1 on May 24, 2007, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the disclosure is that of industrial tooling. More specifically, the disclosure relates to discontinuous clamping wrenches, commonly referred to as impact wrenches or pulse wrenches.

BACKGROUND OF THE DISCLOSURE

Discontinuous clamping wrenches are tools widely used in the industrial sector, particularly in the field of motor vehicle manufacture.

The principle of these wrenches consists of generating torque pulses, which are transmitted to the screw to be tightened.

These pulses are themselves generated by a system comprising:

- a pneumatic motor;
- a pulse clutch;
- an output shaft;
- a casing incorporating the above-mentioned items and wherein a part forms a handle.

The pulse clutch operates cyclically as follows:

- on approximately 170°, the clutch is disengaged and allows the motor to accelerate freely and accumulate kinetic energy;
- on the next 10°, the clutch is engaged and transmits the kinetic energy contained in the rotor of the pneumatic motor to the screw via the output shaft; this kinetic energy is converted into a brief but high-amplitude torque pulse;
- the same cycle is repeated for every subsequent 180° (a period other than 180° may however be envisaged).

Discontinuous clamping wrenches offer the major advantage of enabling clamping at a high torque level with a low reaction torque in the operator's hand.

These tools enable a short clamping cycle time compared to clamping tools applying a continuous rotation movement to the screw until the desired torque level is obtained.

The major drawback is that it is difficult to monitor the effective torque applied in the screw.

It is noted that the term effective torque refers to the torque that would be applied by a torque wrench in a static manner or at a slow speed.

Clamping level monitoring systems have been proposed by the prior art.

In practice, experienced users of impact wrenches know, from experience, how to detect, through the touch sensation provided by the casing during clamping, when the required clamping level has been reached.

In other words, simply holding the tool and sensing the force of the tool provided to the operator via the casing enable the operator to evaluate whether the required clamping level has been reached or not.

However, this practice is based on an interpretation by the operator of the sensations provided by the tool.

Therefore, incorrect results, due to uncertain perception of the clamping level, are frequently observed.

In order to remedy this drawback, clamping level monitoring systems have been proposed by the prior art.

Discontinuous clamping wrenches are known wherein a torque sensor is positioned on the output shaft so as to measure the torque pulses. A solution of this type is described in the patent document published under the number JP-4 115 877 (FIG. 1).

Discontinuous clamping wrenches are also known wherein an angle sensor measures the deceleration of the assembly formed by the pneumatic motor rotor and the clutch casing.

The principle of this solution lies in that the rotoric inertia and the deceleration of the rotor/casing assembly during the torque pulse being known, it is possible to calculate the amplitude thereof.

Such a solution is particularly described in the patent document published under the number WO-2005/05390 (FIG. 2).

In both solutions described above, the torque pulses are then processed by an algorithm to determine whether the required clamping level has been reached.

The major drawback of these technologies is that they require the integration of sensors on the rotating parts, resulting in:

- assembly and/or setting difficulties;
- dependency with respect to wear parts liable to induce, in the long term, a reliability defect;
- complex maintenance operations.

SUMMARY

An embodiment of the invention relates to a discontinuous clamping wrench, of the type comprising a motor and a pulse clutch integrated in a casing, characterised in that it comprises measurement means of dynamic phenomena induced by said clamping on said casing, with a view to correlating said measurement with a clamping level.

In fact, the vibrations applied on the casing are those perceived by the user, the perception of which enables same to evaluate the clamping level.

Therefore, an embodiment of the invention proposes to measure these vibrations so as to automate and/or ensure the reliability of the "touching" practice by users.

In addition, the corresponding measurement means may be associated directly with the casing, which avoids having to fit sensors (angle or torque) on the rotating parts of the tool and remedies assembly and/or setting and/or maintenance difficulties caused by the sensors according to the prior art.

According to one advantageous solution, the wrench comprises analysis means of said dynamic phenomena.

In this way, it is possible to optimise the processing of the vibrations measured, which makes it possible to improve the clamping level detection (or deduction) precision.

Preferentially, said analysis means comprise electronic processing means performing a frequential analysis of said dynamic phenomena.

According to a first embodiment of the invention, the wrench comprises measurement means of the vibrations induced by said clamping on said casing.

In this case, said measurement means preferentially comprise at least one accelerometer mounted on said casing.

Such a component may be proposed in relatively small dimensions, enabling the easy integration thereof on the casing, without having a detrimental effect on the space requirements or handling of the tool.

According to a second embodiment of the invention, the wrench comprises measurement means of angular movements of said casing about a motor axis.

In this case, said measurement means preferentially comprise at least one gyroscope mounted on said casing.

BRIEF DESCRIPTION OF THE DRAWINGS

Other characteristics and advantages will emerge more clearly on reading the following description of a preferential embodiment of the invention, given as an illustrative example, and the appended figures wherein.

DETAILED DESCRIPTION OF ILLUSTRATIVE EMBODIMENTS

Figure 1:
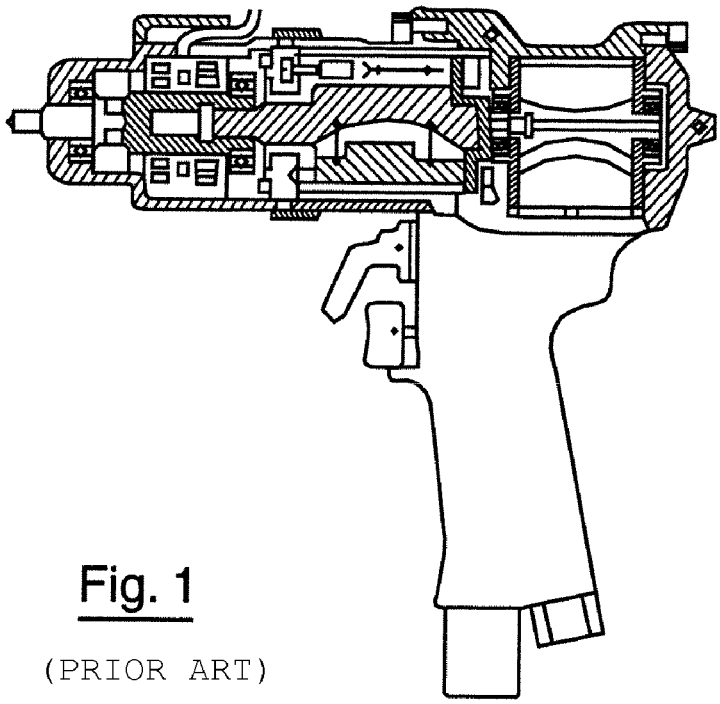
Fig. 1 (PRIOR ART)
FIGS. 1 and 2 are views of discontinuous clamping wrenches according to the prior art.
Figure 2:
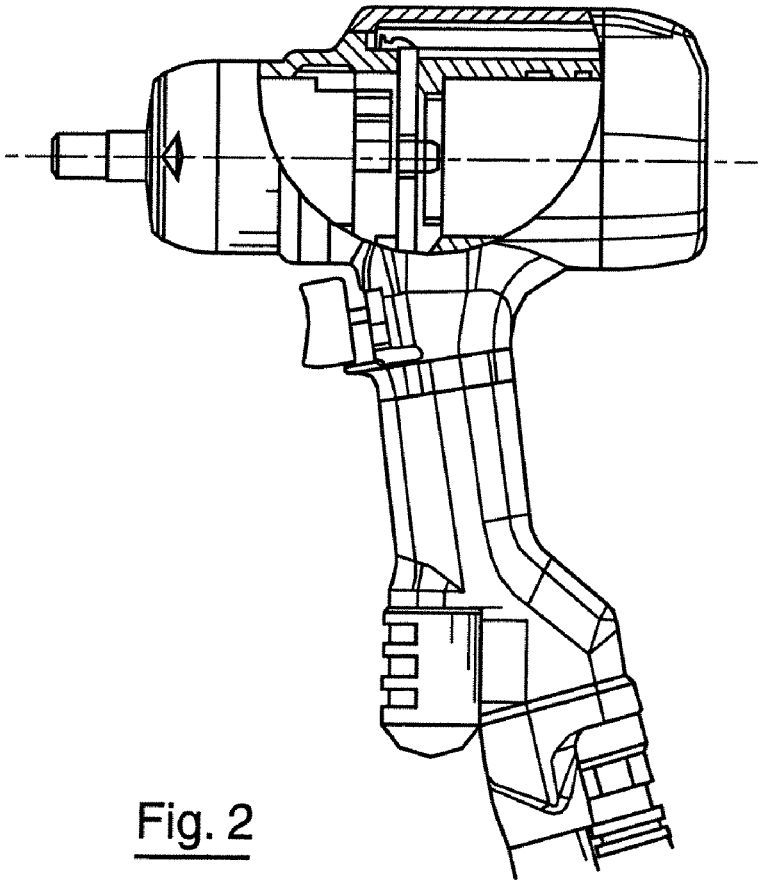
Fig. 2 (PRIOR ART)
Figure 3:
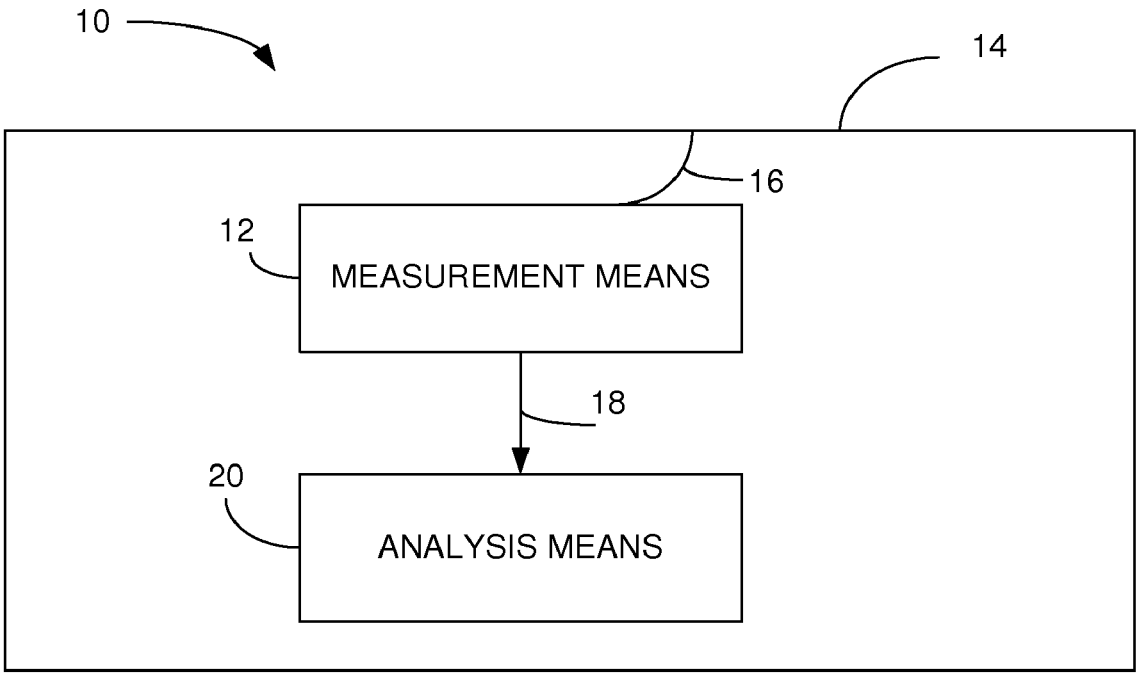
FIG. 3 is a diagram illustrating a discontinuous clamping wrench having measurement means attached to a casing of the wrench.

As described above and shown in FIG. 3, the principle of an embodiment of the invention consists of providing a discontinuous clamping wrench 10 with measurement means 12 of vibratory phenomena applied to the wrench casing 14 during clamping.

These dynamic phenomena are, in particular, those liable to be perceptible by a user such as vibrations of the casing or angular movements of the casing about the motor axis.

According to a first embodiment of the invention, the tool includes one or more accelerometers 12 directly attached 16 on the casing 14 of the tool 10, with a view to detecting the vibrations of the casing.

This accelerometer measures the vibratory repercussions of the clamping process in the tool casing.

It is noted that an accelerometer is an acceleration sensor. A distinction is made between several categories of accelerometers:

- those able to measure a static acceleration (such as gravity);
- those able to measure a dynamic acceleration (vibrations);
- those able to measure either a static or dynamic acceleration.

Naturally, an embodiment of the invention provides for the use of an accelerometer to measure at least one dynamic acceleration.

The accelerometer used may be in the form of an electronic chip, produced using MEMS (Micro-Electro-Mechanical Systems) technology.

According to a second embodiment of the invention, the tool includes one or more gyroscopes 12 attached on the casing so as to be able to detect and measure, with respect to an external reference, the rotation of the casing about the tool motor axis.

Frequential analysis means 20 of the signal 18 supplied by the accelerometer make it possible to determine whether the required clamping level has been reached.

An embodiment of the invention proposes a discontinuous clamping wrench that makes it possible to determine reliably whether a clamping level has been reached, using a simpler solution than those of the prior art.

An embodiment of the invention provides such a technique to determine the clamping level of a discontinuous clamping wrench, which simplifies the assembly and/or maintenance operations of the corresponding means.

An embodiment of the invention provides such a technique that is simple in design, and that is easy and inexpensive to implement.

Although the present disclosure has been described with reference to one or more examples, workers skilled in the art will recognize that changes may be made in form and detail without departing from the scope of the disclosure and/or the appended claims.

The invention claimed is:

1. Discontinuous clamping wrench, comprising:

a motor and a pulse clutch integrated in a casing, measurement means of dynamic phenomena induced on said casing by clamping of the clutch, with a view to correlating said measurement with a clamping level, wherein the measurement means measures vibrations induced by said clamping on said casing.

2. Discontinuous clamping wrench according to claim 1, wherein the wrench further comprises analysis means of said dynamic phenomena measured.

3. Discontinuous clamping wrench according to claim 2, wherein said analysis means comprise electronic processing means for performing a frequential analysis of said dynamic phenomena.

4. Discontinuous clamping wrench according to claim 1, wherein said measurement means comprise at least one accelerometer mounted on said casing.

5. Discontinuous clamping wrench of claim 4, wherein the at least one accelerometer is non-rotating.

6. Discontinuous clamping wrench according to claim 1, wherein the measurement means measures angular movements of said casing about a motor axis.

7. Discontinuous clamping wrench according to claim 6, wherein said measurement means comprise at least one gyroscope mounted on said casing.

8. Discontinuous clamping wrench of claim 1, wherein the measurement means is directly attached to the casing.

9. Discontinuous clamping wrench of claim 1, wherein the measurement means is attached to a non-rotating element of the casing.

10. A discontinuous clamping wrench comprising:

a motor and a pulse clutch integrated in a casing; and an accelerometer mounted on said casing, which measures vibrations induced on said casing by clamping of the clutch.

11. The discontinuous clamping wrench of claim 10, wherein the accelerometer is non-rotating.

* * * * *